US006439294B1

(12) United States Patent
Boswell

(10) Patent No.: US 6,439,294 B1
(45) Date of Patent: Aug. 27, 2002

(54) CARBURETOR WITH PRIMARY AND SECONDARY FUEL DELIVERY CIRCUITS AND METHODS OF OPERATION AND INSTALLATION OF THE SAME

(76) Inventor: George A. Boswell, 806 Burnett St., Eagle River, WI (US) 54521

( * ) Notice: Subject to any disclaimer, the term of this patent is extended or adjusted under 35 U.S.C. 154(b) by 0 days.

(21) Appl. No.: 09/654,467

(22) Filed: Sep. 1, 2000

Related U.S. Application Data

(62) Division of application No. 09/242,032, filed as application No. PCT/US98/11754 on Jun. 5, 1998, now Pat. No. 6,149,140.

(60) Provisional application No. 60/048,907, filed on Jun. 6, 1997.

(51) Int. Cl.[7] ..... B22D 23/00; F02M 7/10

(52) U.S. Cl. ..... 164/47; 261/40; 261/67; 261/DIG. 39

(58) Field of Search ..... 261/40, 67, 36.1, 261/69.1, DIG. 39; 164/418, 271, 47

(56) References Cited

U.S. PATENT DOCUMENTS

| | | | | | |
|---|---|---|---|---|---|
| 2,229,819 | A | | 1/1941 | Reid | 261/76 |
| 2,462,696 | A | * | 2/1949 | Warburton | 261/51 |
| 2,957,683 | A | | 10/1960 | Eberhardt | 261/41 |
| 3,030,084 | A | | 4/1962 | Phillips | 261/41 |
| 3,066,922 | A | | 12/1962 | Wucherer | 261/41 |
| 4,000,224 | A | | 12/1976 | Phelps | 261/36 A |
| 4,065,526 | A | | 12/1977 | Englert et al. | 261/62 |
| 4,075,296 | A | | 2/1978 | Orsini et al. | 261/41 D |
| 4,268,462 | A | * | 5/1981 | Ota et al. | 261/40 |
| 4,375,438 | A | | 3/1983 | McKay | 261/23 A |
| 4,447,370 | A | | 5/1984 | Kobayashi et al. | 261/35 |
| 4,578,228 | A | | 3/1986 | Gerhardy | 261/41 D |
| 4,861,522 | A | | 8/1989 | Gerhardy et al. | 261/35 |
| 4,877,560 | A | * | 10/1989 | Kenny et al. | 261/35 |
| 4,903,655 | A | | 2/1990 | Vonderau et al. | 123/198 C |
| 4,966,735 | A | * | 10/1990 | LoRusso | 261/DIG. 39 |
| 5,133,905 | A | | 7/1992 | Woody et al. | 261/35 |
| 5,386,145 | A | | 1/1995 | Boswell | 261/41.1 |
| 5,662,077 | A | | 9/1997 | Boswell | 123/184.21 |
| 6,149,140 | A | * | 11/2000 | Boswell | 261/40 |

FOREIGN PATENT DOCUMENTS

| | | | | |
|---|---|---|---|---|
| IT | 578442 | * | 6/1958 | 261/40 |

* cited by examiner

*Primary Examiner*—Richard L. Chiesa
(74) *Attorney, Agent, or Firm*—Haverstock, Garrett & Roberts LLP

(57) ABSTRACT

A carburetor having a plurality of orifices at different locations adjacent to the sidewall of the airflow passage therethrough and connecting passages communicating the orifices with a fuel source, such that different airflow conditions through the airflow passageway will generate different negative pressure conditions in the respective orifices and connecting passages, such that fuel will be drawn to the airflow passageway through the orifice or orifices and connected passage or passages with the greatest negative pressure conditions therein, a primary operational result being fuel delivery capable of rapidly changing corresponding to rapidly changing airflow conditions in the airflow passageway corresponding to changing operating conditions.

8 Claims, 9 Drawing Sheets

CARBURETOR WITH PRIMARY AND SECONDARY FUEL DELIVERY CIRCUITS AND METHODS OF OPERATION AND INSTALLATION OF THE SAME

This application is a divisional application of patent application Ser. No. 09/242,032, filed Feb. 5. 1999, now U.S. Pat. No. 6,149,140, which is a national stage application of International Application No. PCT/US98/11754, filed Jun. 5, 1998, and which claims the benefit of provisional application No. 60/048,907, filed Jun. 6, 1997,

FIELD OF THE INVENTION

The present invention relates to carburetors for internal combustion engines, and more particularly, to primary and secondary fuel delivery circuits therefor and methods for the operation and installation of same.

SUMMARY OF THE INVENTION

According to one aspect of the present invention, a carburetor including a chamber for receiving and holding fuel, a sidewall forming a passageway for the flow of air therethrough having an inlet opening and an outlet opening and a constricted portion therebetween further includes a plurality of orifices at different locations adjacent to the sidewall in communication with the air flow passageway, and connecting passages connecting the orifices with the fuel chamber. The various orifices are positioned at different locations in the air flow passageway such that different air flow conditions through the air flow passageway will generate different negative pressure conditions in the respective orifices and connecting passages, such that fuel will be drawn to the air flow passageway through the orifice or orifices and connecting passage or passages with the greatest negative pressure conditions therein, the operational result being fuel delivery capable or rapidly changing corresponding to rapidly changing air flow conditions in the air flow passageway corresponding to changing operating conditions.

According to another aspect of the present invention, the carburetor has a primary fuel delivery circuit including a primary fuel passage extending from the fuel holding chamber to a primary fuel delivery orifice located in communication with the air flow passageway. At least one secondary fuel delivery circuit is providing including at least one orifice in communication with the air flow passageway adjacent to the carburetor sidewall. At least one connecting passage communicates the at least one orifice with the primary fuel delivery circuit. In operation, different air flow conditions through the air flow passageway will generate different negative pressure conditions in the various orifices, under some air flow conditions fuel being drawn into the primary fuel delivery circuit by the negative pressure conditions and exiting into the air flow passageway through the orifices and connecting passageways having the greater negative pressure conditions therein, the fuel delivery characteristics being rapidly changeable corresponding to changing air flow conditions.

The circuitry according to the present invention can be easily and readily installed on a wide variety of known carburetor construction, and in new carburetor constructions.

In operation, it has been observed that the fuel exiting the orifices into the air flow passageway is in a highly vaporized state, which in combination with the ability of the fuel delivery to rapidly change corresponding to changes in air flow conditions, provides enhanced engine performance and response.

DETAILED DESCRIPTION OF THE PREFERRED EMBODIMENT

Figure 1:
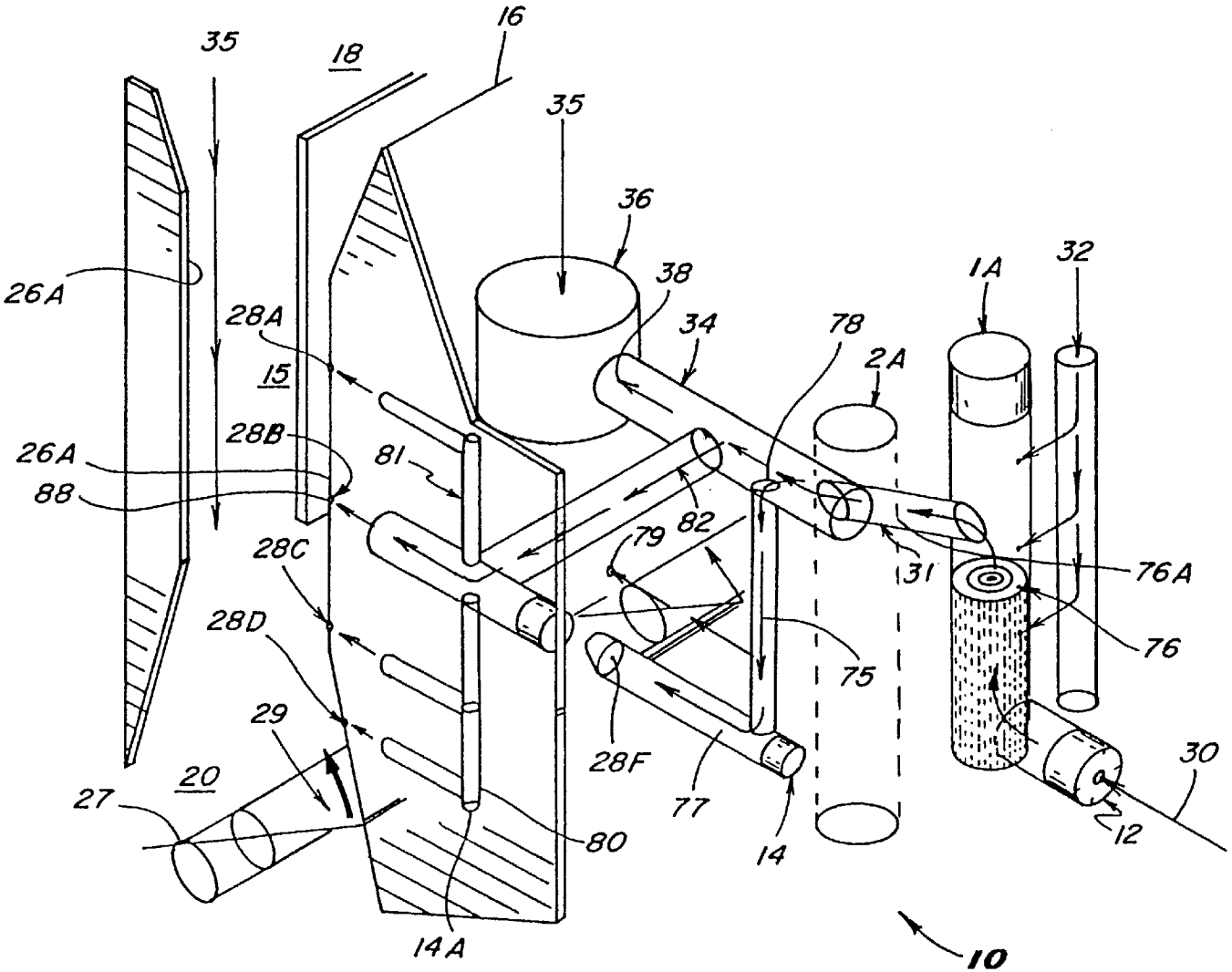
FIG. 1 is an isometric representation of pertinent aspects of a typical carburetor including a conventional primary fuel delivery circuit and a plurality of secondary fuel delivery circuits according to the present invention.

Referring to the drawings more particularly by reference numbers wherein like numerals refer to like parts, FIG. 1 is an isometric representation of a typical carburetor 10 including a conventional prior art primary fuel delivery circuit 12, and secondary fuel delivery circuits 14 and 14A according to the present invention. Carburetor 10 includes a body portion (mostly not shown for clarity) which includes a sidewall portion 16 defining an air flow passageway 15 extending between an inlet opening 18 and an outlet opening 20, sidewall 16 forming a constricted portion 22 intermediate inlet opening 18 and outlet opening 20. Carburetor 10 includes a throttle plate 29 located in passageway 15 downstream of constricted portion 22, throttle plate 29 being mounted on a shaft 27 for rotation therewith for controlling the airflow through the passageway in the conventional manner. Generally, carburetor 10, minus secondary fuel delivery circuits 14 and 14A, is representative of numerous known commercially available carburetors used for internal combustion engines for a wide range of devices such as automobiles, motorcycles, aircraft, watercraft, off road sport vehicles, and other internal combustion engine powered devices. Carburetor 10 additionally includes a chamber for receiving and holding fuel (deleted for clarity) in communication with a fuel tube No. 1A or a fuel tube No. 2A (shown in dotted lines) of primary fuel delivery circuit 12. Primary circuit 12 further includes a cross over tube 76A which communicates fuel tube No. 1A or No. 2A with a booster tube 34 of the primary circuit, which booster tube 34 communicates with a primary fuel delivery orifice 38 located in a booster 36 in the air flow passageway.

Figure 2:
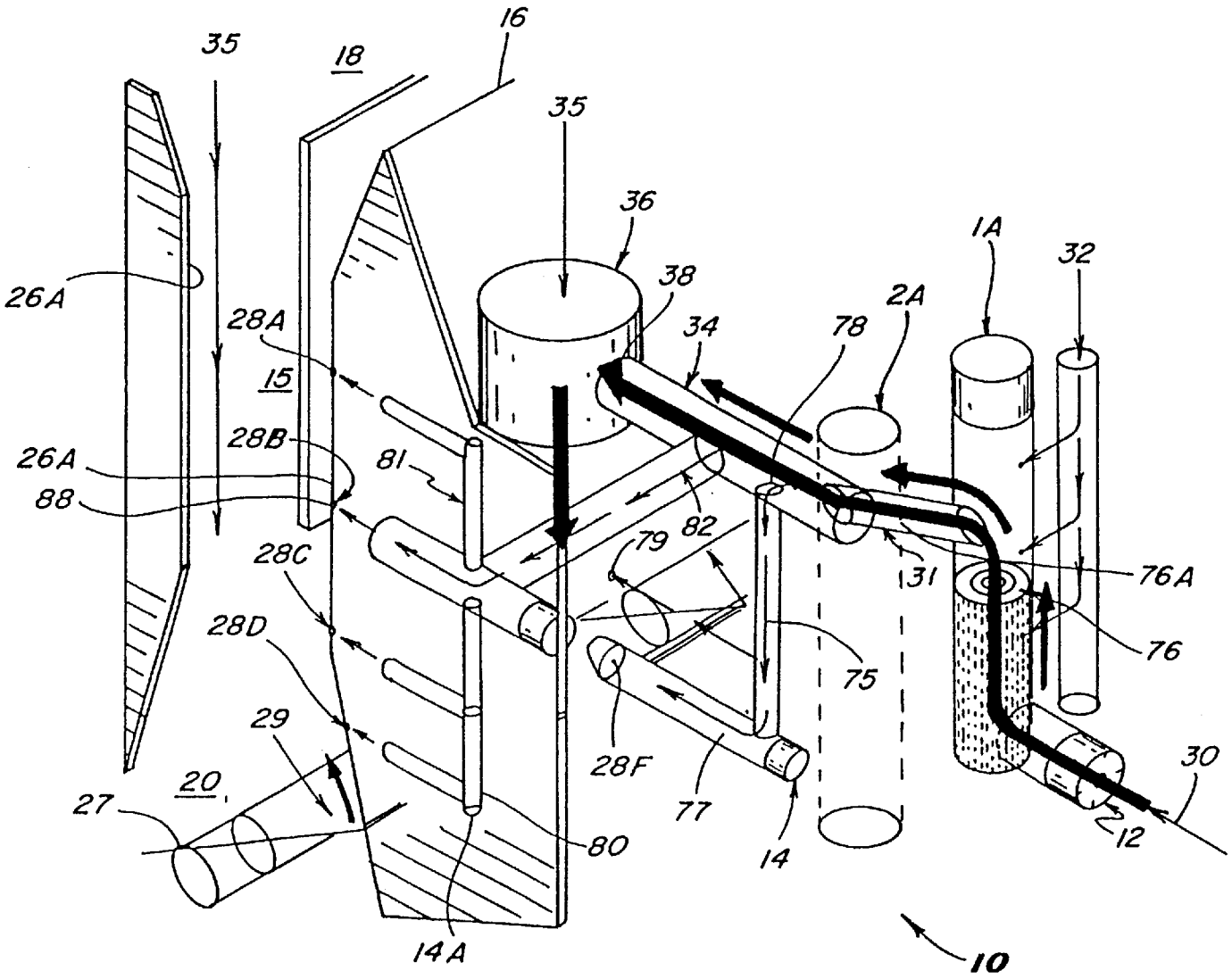
FIG. 2 is an isometric representation of the carburetor of FIG. 1 showing fuel delivery through the primary fuel delivery circuit thereof.

Referring to FIG. 2, under normal operating conditions of primary fuel delivery circuit 12, fuel represented by the arrow 30 flows into fuel tube No. 1A or No. 2A where it collects represented by the shaded area. Note here that the primary difference between fuel tubes No. 1A and No. 2A is that fuel tube No. 1A includes a parallel emulsion tube having cross over passages for introducing air represented by the arrow 32 from atmosphere into the fuel collected in the tube No. 1A. As air flows through the carburetor air flow passageway 15 and booster 36 (the air flow being represented by the arrows 35) a negative pressure condition is generated in primary fuel delivery orifice 38 and in booster tube 34. This negative pressure condition is communicated from booster tube 34 to fuel tube No. 2A or through cross over tube 76A to fuel tube No. 1A to cause fuel to be drawn into and through booster tube 34 (shown by additional shading and large arrows), where the fuel exits through primary fuel delivery orifice 38 into booster 36, where air flow 35 mixes with the fuel and carries it through air flow passageway 15 into the internal combustion engine (not shown), the amount of fuel drawn through the primary circuit roughly corresponding to the degree of air flow through air flow passageway 15.

Again referring to FIG. 1, secondary fuel delivery circuit 14 includes a connecting passage 75 having one end in communication with booster tube 34 and an opposite end in communication with a connecting passage 77, which connecting passage 77 communicates with a fuel delivery orifice 28F on sidewall 16 in communication with air flow passageway 15 upstream of throttle plate 29.

Secondary fuel delivery circuit 14A similarly includes a connecting passage 82 having one end in communication with booster tube 34 and an opposite end in communication with a connecting passage 98, which in turn communicates with connecting passages 80 and 81. Connecting passage 81 in turn communicates with orifice 28A at an upper position on sidewall 16 in communication with air flow passageway 15. Connecting passage 98 communicates with orifice 28B at a first intermediate position on sidewall 16 in communication with air flow passageway 15. And, connecting passage 80 communicates with orifices 28C and 28D at lower positions on sidewall 16 in communication with air flow passageway 15. Each of the orifices 28A–28F is located upstream of throttle plate 29. The different locations of orifices 28A–28F in communication with air flow passageway 15 is an important feature of the present invention as it has been found that air flow characteristics through air flow passageway 15 will differ at different locations in the air flow passageway. By placing orifices of a fuel delivery circuit at different locations where correspondingly different air flow characteristics are anticipated, better fuel delivery more responsive to changing air flow conditions reflecting engine demand and other conditions can be achieved.

Figure 3:
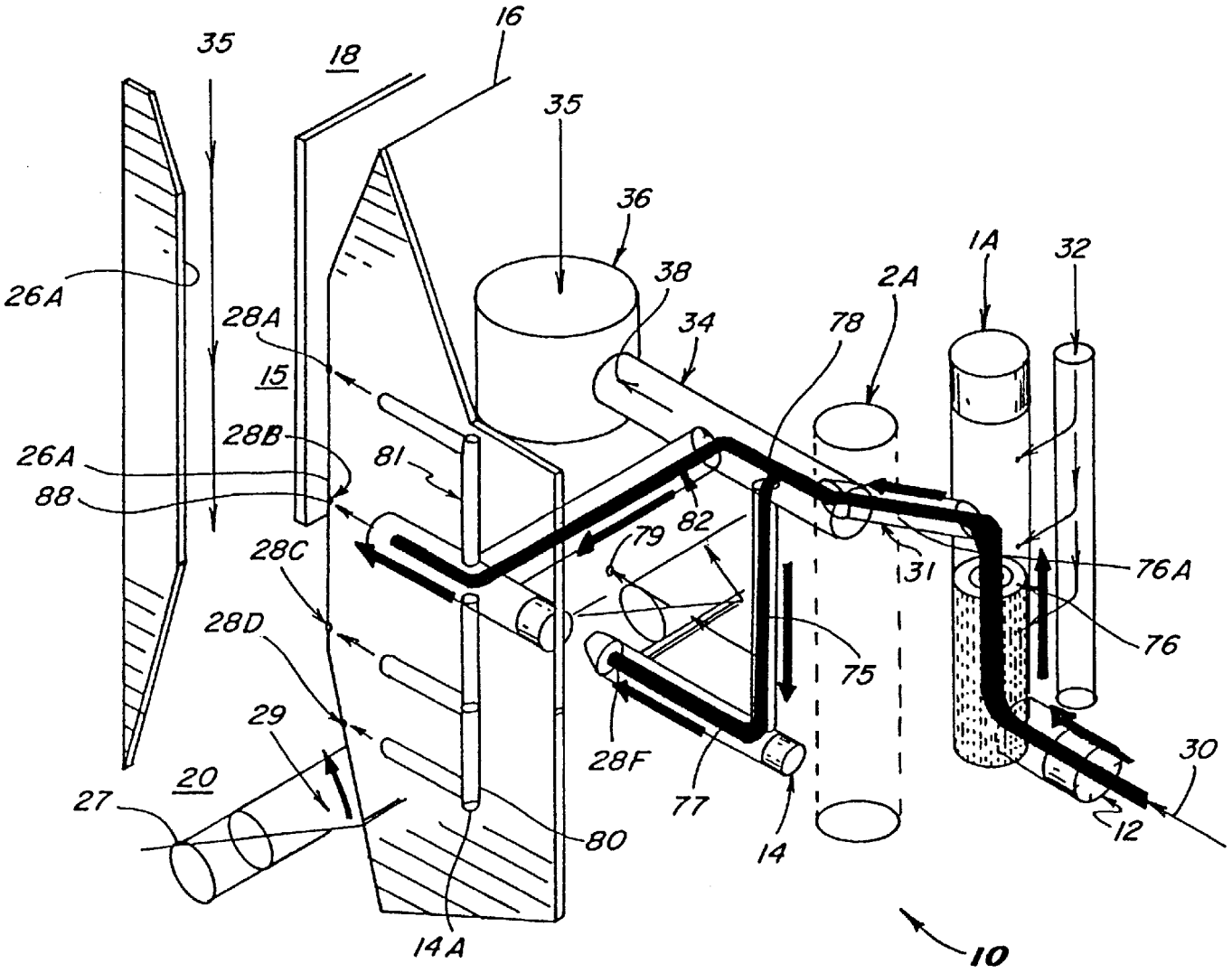
FIG. 3 is another isometric representation of the carburetor of FIG. 1 showing fuel delivery through the secondary fuel delivery circuits of the present invention under low air speed operating conditions.

Referring now to FIG. 3, fuel delivery to air flow passageway 15 by primary fuel delivery circuit 12 and secondary fuel delivery circuits 14 and 14A for lower air flow conditions corresponding to low speed throttle conditions and low engine demand, is shown by shading and large black arrows. As can be seen, fuel 3O enters primary fuel delivery circuit 12 from the fuel holding chamber (not shown) where it accumulates in fuel tube No. 1A (or No. 2A). The fuel is then drawn through cross over tube 76A into booster tube 34 wherein the fuel travels through connecting passages 75 and 82. From connecting passages 75 and 82, the fuel travels into connecting passages 77 and 98, and exits into air flow passageway 15 through orifices 28B and 28F, which generate the highest negative pressure or vacuum signals under this air flow condition. Here, it has been observed that the fuel exiting orifices 28B and 28F is at a high degree of vaporization, which significantly contributes to enhanced performance provided by the secondary fuel delivery circuits 14 and 14A of the present invention.

Figure 4:
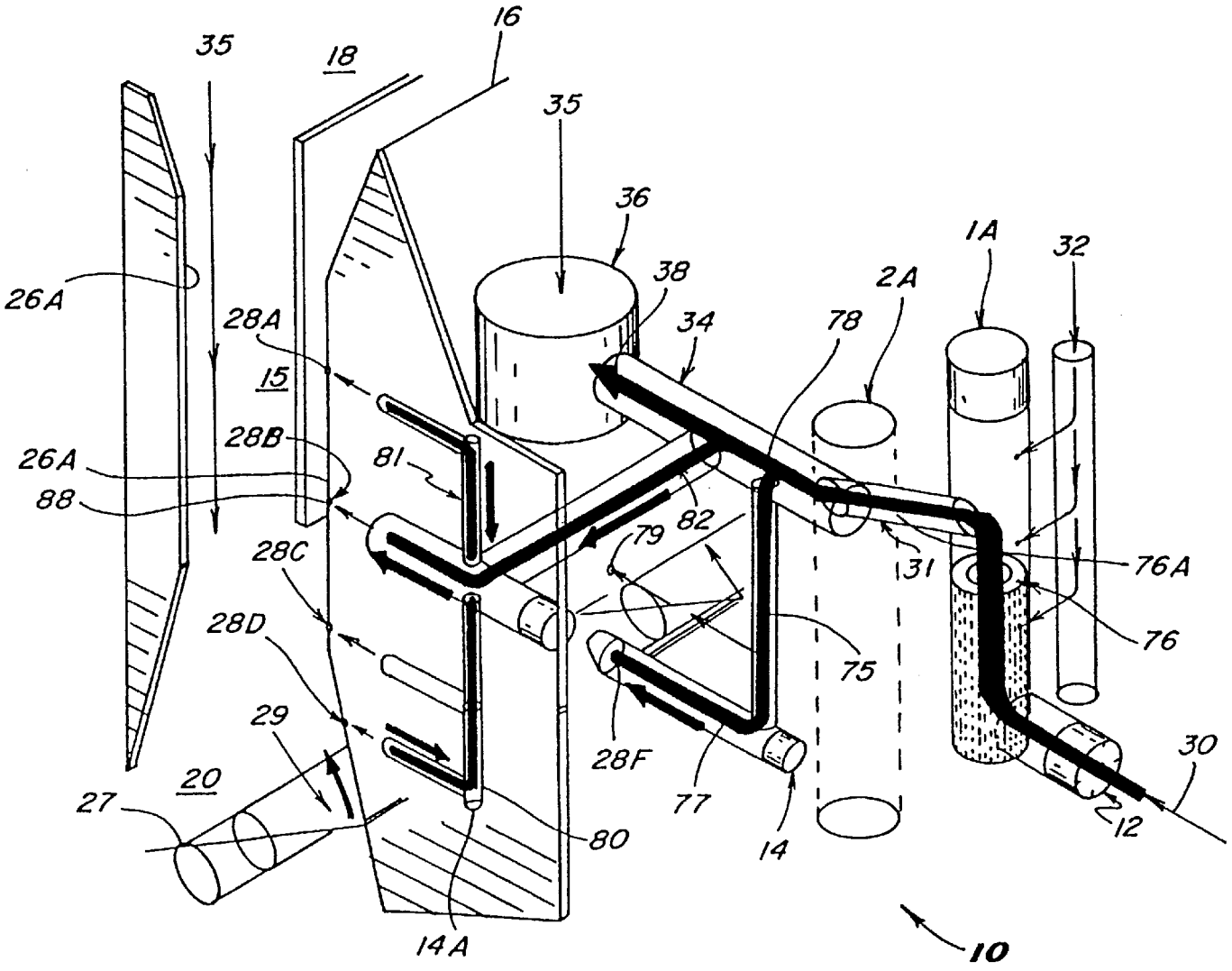
FIG. 4 is another isometric representation of the carburetor of FIG. 1 showing fuel delivery through the primary fuel delivery circuit and the secondary fuel delivery circuits of the present invention under higher air speed operating conditions.

FIG. 4 shows the fuel delivery characteristics of primary delivery circuit 12 and secondary fuel delivery circuits 14 and 14A, shown by shading and large black arrows, under higher air flow conditions corresponding to greater engine demand. Here, fuel 30 again enters fuel tube No. 1A (or No. 2A) from which it is drawn into booster tube 34. Some of the fuel then exits through primary fuel delivery orifice 38 into air flow passageway 15 through booster 36. Also, and importantly, additional fuel is drawn from booster tube 34 into connecting passage 75 where the fuel then flows through connecting passage 77 and orifice 28F into air flow passageway 15. Still further, fuel is also drawn through connecting passage 82 into connecting passage 98 where the fuel exits into air flow passageway 15 through orifice 28B. Here it should be noted that under these conditions the negative pressure conditions at orifice 28B can be sufficiently strong to reverse flow in the other orifices, that is, to draw air from air flow passageway 15 into orifices 28A, 28C, and/or 28D, through connecting passageway 80 and 81 into connecting passage 98 where the air mixes with the fuel and exits back into air flow passageway 15 through orifice 28B as shown. Again, the fuel exiting orifices 28B and 28F is highly vaporized, which provides the above discussed advantages.

It is important to recognize when studying the operation of secondary fuel delivery circuits 14 and 14A that all of the interconnected connecting passages are directly influenced by the strongest overriding circuit. That is, the negative pressure conditions in the portion of the fuel delivery circuits wherein the negative pressure signal or signals are strongest can cause fuel delivery through the circuit portions with weaker negative pressure signals to stall and even reverse, as illustrated in FIG. 4, so as to supply additional fuel an/or air to the stronger portions of the circuit. Also, it is also important to note that prior to the reversal of the flow in the circuit portions, the circuits can be in an equilibrium state charged with fuel which enables them to become the stronger circuits virtually instantaneously as air flow changes such that the circuits can be said to essentially have a "self-seeking" feature which enables them to deliver the fuel to the orifice or orifices where the vacuum signal is strongest. Still further, and importantly, the fuel delivery orifices 28A–28F can be placed in various locations throughout the air flow passageway 15 and are not restricted by the shape of sidewall surface 16, although placing orifices 28A–28F on surfaces having optimal air flow characteristics may provide certain advantages.

Figure 5:
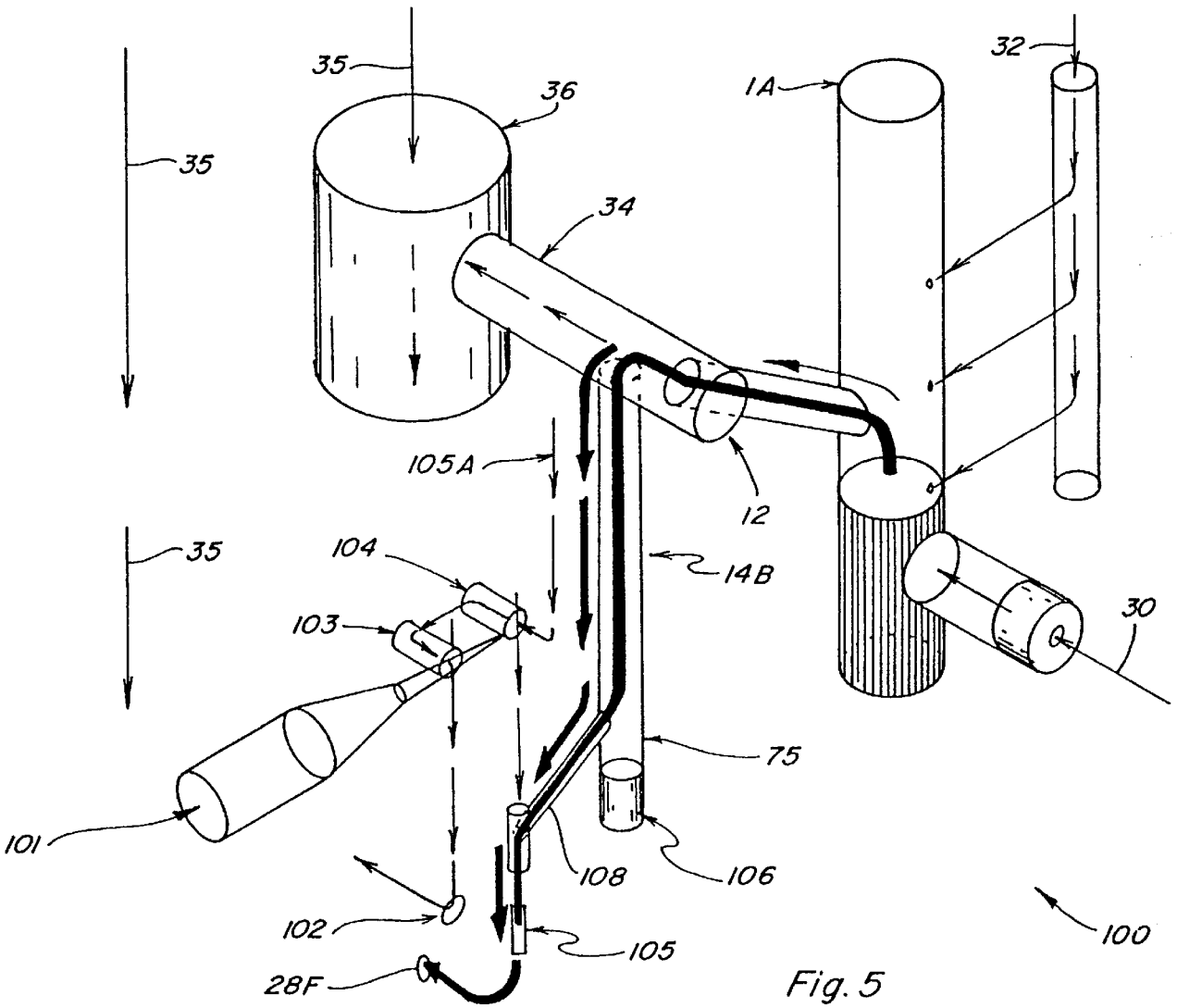
FIG. 5 is an isometric representation of a prior art carburetor including a conventional primary fuel delivery circuit and a secondary fuel delivery circuit according to the present invention.

Referring to FIG. 5 an isometric representation of a typical prior art carburetor 100 including a conventional prior art primary fuel delivery circuit 12 as discussed above and a secondary fuel delivery circuit 14B according to the present invention. Carburetor 100 includes a typical prior art idle fuel circuit including an idle adjusting screw 101, an idle port 102 for discharging fuel into the airflow passageway of the carburetor, an idle inlet 103 which receives fuel through an idle supply passage 105A, and an idle transfer passage 104 which communicates fuel from the idle circuit to an intermediate circuit 105. Secondary fuel delivery circuit 14B includes a connecting passage 75 and a connecting passage 108 for communicating booster tube 34 with intermediate circuit 105, which has the resultant effect of converting the existing intermediate fuel delivery orifice into the equivalent of secondary fuel delivery orifice 28F as indicated. To illustrate, normal fuel flow is shown by the thin black arrows separately through booster tube 34 into the airflow passgeway and through passage 105A to the idle fuel circuit, some of the fuel exiting through idle orifice 102 and some flowing through transfer passage 104 to the intermediate fuel circuit. Fuel flow through the new secondary fuel delivery circuit 14B is shown by the heavy black arrows as flowing from booster tube 34 through transfer passage 75 to transfer passage 108 which provides fuel to the intermediate circuit, such that the orifice thereof is utilized as a secondary fuel delivery orifice 28F.

Figure 6:
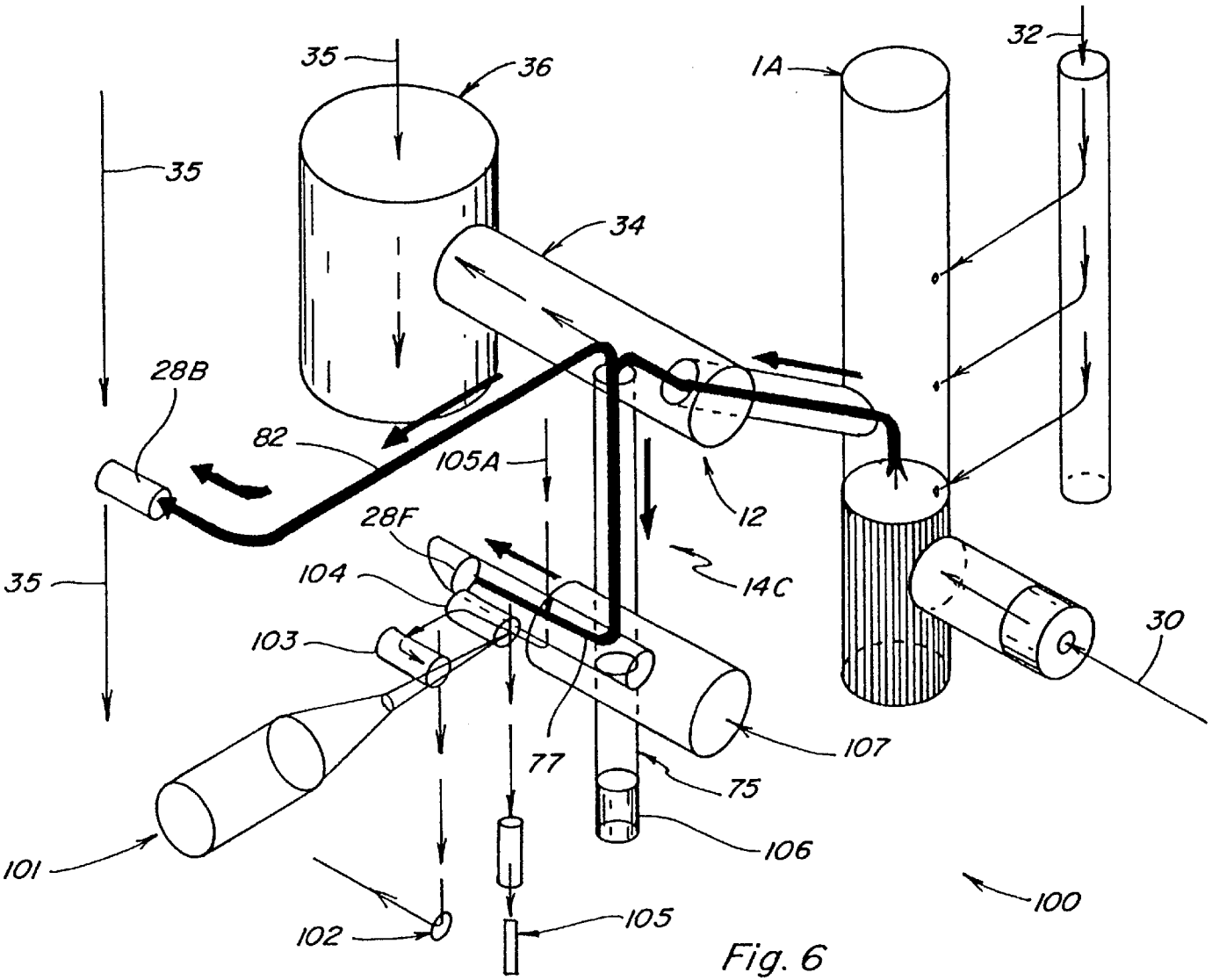
FIG. 6 is an isometric representation of the carburetor of FIG. 5 including an alternative secondary fuel delivery circuit according to the present invention.

Turning to FIG. 6, the carburetor 100 is shown including conventional prior art primary fuel delivery circuit 12, and another secondary fuel delivery circuit 14C according to the present invention. Circuit 14C includes transfer passage 75 as above which passes through a plug 107 having an intersecting passage 77 communicating with a secondary fuel delivery orifice 28F. Circuit 14C additionally includes a connecting passage 82 formed therein communicating with a secondary fuel delivery orifice 28B as shown. Again, conventional fuel delivery is shown by thin black arrows wherein fuel is supplied to the idle and intermediate fuel circuits through passage 105A. Fuel delivery through secondary fuel delivery circuit 14C is through connecting passages 82 and 75 to delivery orifices 28B and 28F.

Figure 7:
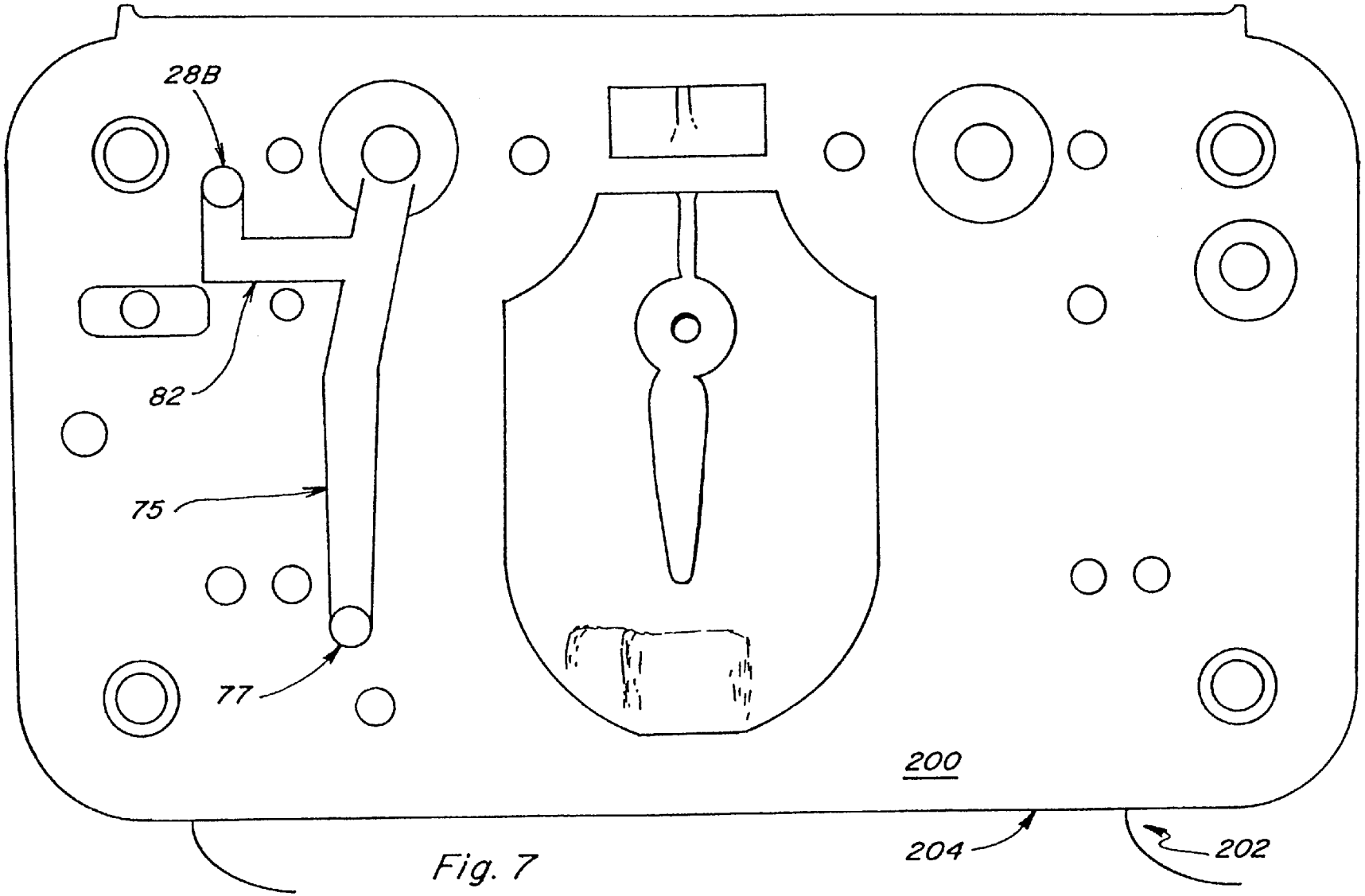
FIG. 7 is a plan view of the main body to metering block surface of a typical Holley brand carburetor showing installation of the secondary fuel delivery circuits of FIGS. 5 and 6 therein according to the present invention.

Turning to FIG. 7, a main body to metering block gasket surface 200 of a typical prior art Holley brand carburetor 202 is shown including modifications to provide both secondary fuel delivery circuits 14B and 14C according to the present invention therein. Here, the number 7 corresponds to the passageway through booster tube 34 of primary fuel delivery circuit 12 of the carburetor embodiment 100 discussed above. The secondary circuits are added to the carburetor by forming a groove in the main body to metering block gasket surface 200 which will form connecting passage 75 when the corresponding gasket (not shown) is placed thereover; forming a connecting passage 77 in the main body 204 in communication with connecting passage 75; forming a groove in the main body to metering block gasket surface 200 in connection with connecting passage 75 which will form connecting passage 82 when the gasket is placed on the surface; and forming an orifice 28B in the main body 204 communicating with connecting passage 82 and the air flow passageway through the carburetor (not shown), and an orifice 28F communicating connecting passage 77 with the air flow passage (also not shown). With this relatively simple and easy modification, a Holley brand carburetor such as the one shown in FIG. 5 will typically boost both the horsepower and torque of an internal combustion engine on which it is used by a significant amount.

The above modifications to carburetor 202 can be made using conventional machining practices. Also, such modifications can be made at the time of manufacture of the main body 204 by casting passages 75, 77 and 82, and the orifices 28B and 28F into the body when it is cast, or by later machining any of the passages and/or orifices therein in a subsequent operation.

Figure 8:
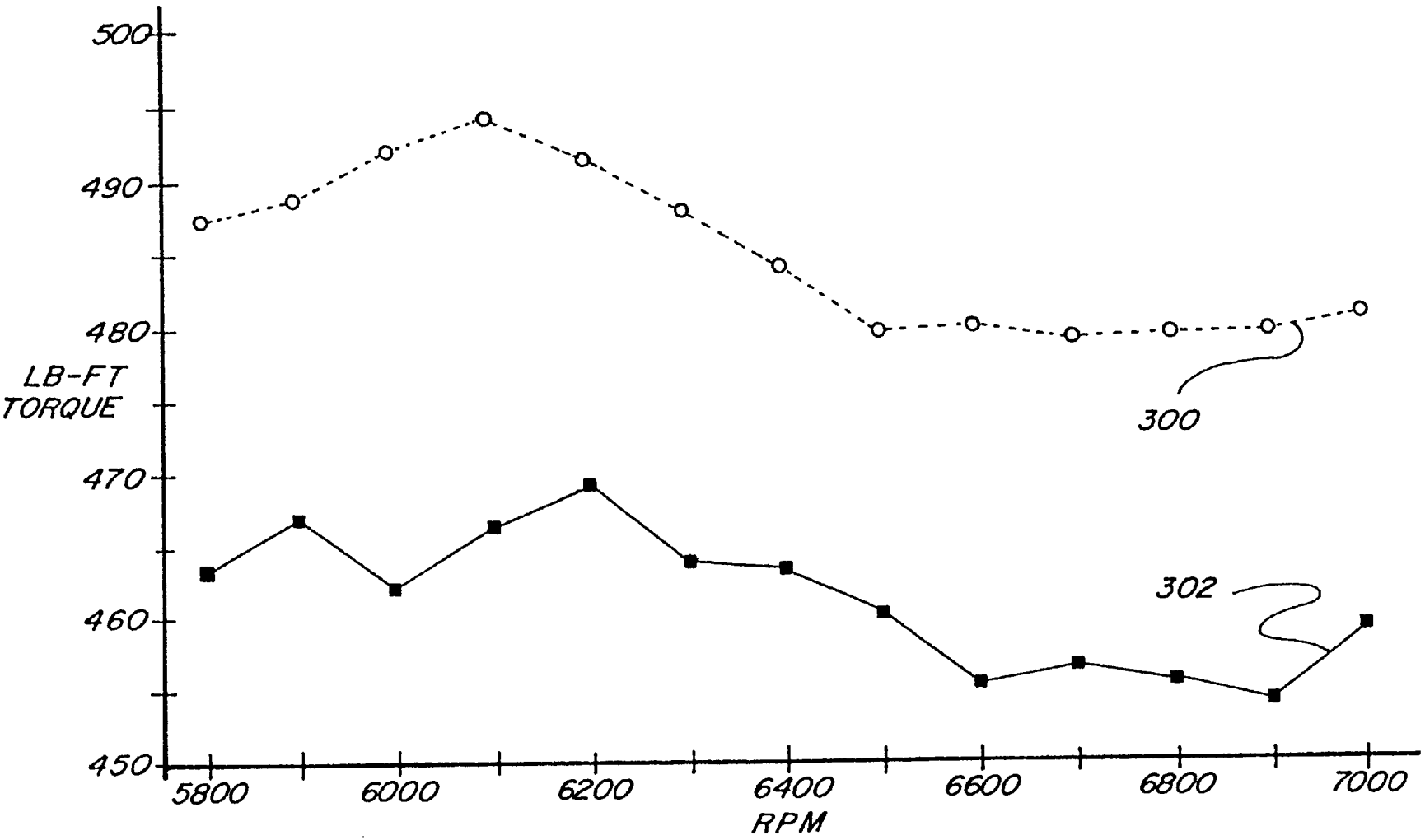
FIG. 8 is a graphical representation of torque versus RPM for an engine utilizing a carburetor including the secondary fuel delivery circuit of FIG. 6.

FIG. 8 is a graphical representation of torque versus revolutions per minute (RPM) an engine using a Holley brand carburetor modified to include the secondary fuel delivery circuit 14C of FIG. 6 above, compared to the same Holley brand carburetor model without the new secondary fuel delivery circuit. Here, the curve 300 represents the torque versus RPM curve for the engine with the modified carburetor including circuit 14C, and the curve 302 represents the engine with the unmodified carburetor. It can be see that torque is increased throughout an RPM range of between 5800 and 7000 by approximately 20 lb/ft with the modification.

Figure 9:
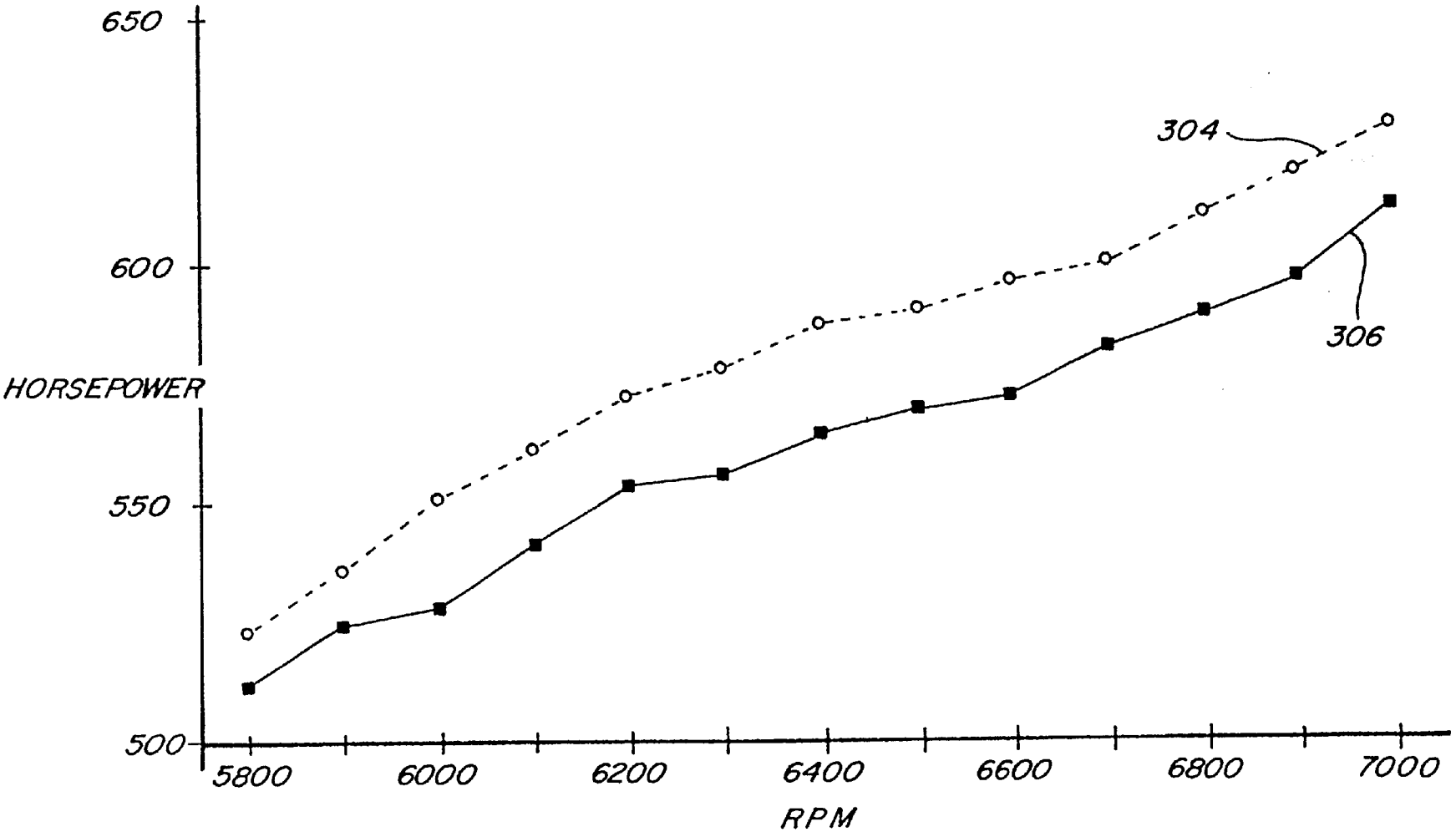
FIG. 9 is a graphical representation of horsepower versus RPM for the engine using the secondary fuel delivery circuit of FIG. 6.

FIG. 9 is a graphical representation of horsepower versus RPM for the same carburetors, the curve 304 representing horsepower versus RPM for the carburetor including the modifications 14C, the curve 306 representing horsepower versus RPM for the unmodified carburetor. As can be seen, the modified carburetor provides approximately 20 more horsepower over the range of 5800 to 7000 RPM. Both the horsepower increase and torque increase over the RPM range shown is important, as that is the RPM range most used by the tested engines, which are stock car engines.

Thus there has been show and described herein a novel invention of carburetor with primary and secondary fuel delivery circuits and methods of operation and installation of the same which fulfill all of the objects and advantages set forth therefore. It will be apparent to those skilled in the art, however, that many changes, modifications, variations and other uses and applications for the subject invention are possible. All such changes, modifications, variations and other uses and applications which do not depart from the spirit and scope of the invention are deemed to be covered by the invention, which is limited only by the claims which follow.

What is claimed is:

1. A method for forming at least one secondary fuel delivery circuit in a carburetor having a primary fuel delivery circuit including a primary fuel delivery passage extending through a body portion of the carburetor from an interface surface located to be disposed between the body portion and a fuel metering block removably mountable thereto to a primary fuel delivery orifice in communication with an air flow passageway extending through the carburetor, comprising the following step:

forming at least one passage in the body portion of the carburetor and in the interface surface for connecting the primary fuel delivery passage to at least one additional orifice at another location in communication with the air flow passageway extending through the carburetor.

2. The method according to claim 1 wherein interface surface is a main body to metering block gasket surface.

3. The method according to claim 1 wherein the at least one passage is cast in the body portion of the carburetor.

4. The method according to claim 1 wherein said at least one passage is cast in the body portion of the carburetor.

5. The method according to claim 1 comprising forming two of the passages connecting the primary fuel delivery passage to two of the additional orifices at different locations in communication with the air flow passageway extending through the carburetor.

6. The method according to claim 5 wherein the two of the passages connecting the primary fuel delivery passage to the two of the additional orifices are located at different elevations in the body of the carburetor.

7.The method according to claim 1, wherein the at least one passage formed in the body portion of the carburetor includes a passage located at an elevation in the body portion about equal to an elevation of the primary fuel delivery passage.

8. The method according to claim 1 wherein the at least one passage formed in the body portion of the carburetor includes a passage located at an elevation in the body portion lower than an elevation of the primary fuel delivery passage.

* * * * *